US008398879B2

(12) United States Patent
Muramatsu et al.

(10) Patent No.: US 8,398,879 B2
(45) Date of Patent: Mar. 19, 2013

(54) SOFT MAGNETIC POWDERED CORE AND METHOD FOR PRODUCING SAME

(75) Inventors: Kohei Muramatsu, Kashiwa (JP); Chio Ishihara, Tokyo (JP); Masaki Yanaka, Matsudo (JP)

(73) Assignee: Hitachi Powdered Metals Co., Ltd., Chiba (JP)

( * ) Notice: Subject to any disclaimer, the term of this patent is extended or adjusted under 35 U.S.C. 154(b) by 0 days.

(21) Appl. No.: 13/384,995

(22) PCT Filed: Jul. 8, 2010

(86) PCT No.: PCT/JP2010/061615
§ 371 (c)(1),
(2), (4) Date: Jan. 19, 2012

(87) PCT Pub. No.: WO2011/010561
PCT Pub. Date: Jan. 27, 2011

(65) Prior Publication Data

US 2012/0119134 A1 May 17, 2012

(30) Foreign Application Priority Data

Jul. 23, 2009 (JP) ..... P2009-171879

(51) Int. Cl.
*H01F 1/24* (2006.01)

(52) U.S. Cl. ..... 252/62.55; 148/104; 148/306

(58) Field of Classification Search ..... None
See application file for complete search history.

(56) References Cited

U.S. PATENT DOCUMENTS

| | | | | |
|---|---|---|---|---|
| 2005/0030143 | A9* | 2/2005 | Satoh et al. | 336/200 |
| 2005/0236071 | A1* | 10/2005 | Koshiba et al. | 148/304 |
| 2007/0290065 | A1 | 12/2007 | Brown et al. | |
| 2007/0290161 | A1* | 12/2007 | Tokuoka et al. | 252/62.54 |
| 2008/0100410 | A1* | 5/2008 | Tomita et al. | 336/233 |
| 2010/0266861 | A1* | 10/2010 | Tajima et al. | 428/546 |

FOREIGN PATENT DOCUMENTS

| | | | |
|---|---|---|---|
| CN | 1677585 | A | 10/2005 |
| JP | 56-155510 | A | 12/1981 |
| JP | 9-320830 | A | 12/1997 |
| JP | 2004-146804 | A | 5/2004 |
| JP | 2004-288983 | A | 10/2004 |
| JP | 2005-286145 | A | 10/2005 |
| JP | 2005-317937 | A | 11/2005 |
| JP | 2006-100813 | A | 4/2006 |
| JP | 2006-183121 | A | 7/2006 |

OTHER PUBLICATIONS

Machine Translation of Japanese Patent Document No. JP 2004-288983, Oct. 14, 2004.*

* cited by examiner

*Primary Examiner* — John Sheehan
(74) *Attorney, Agent, or Firm* — Nath, Goldberg & Meyer; Jerald L. Meyer; Sanjana Mangalagiri

(57) ABSTRACT

A powder mixture, which contains a soft magnetic powder and an insulating powder lubricant in an amount of 0.1% by mass or more relative to the soft magnetic powder, is formed by compacting at a compacting pressure of 800 MPa or less, thereby obtaining a powder compact that has a space factor of the soft magnetic powder of 93% or more. The powder compact can be used as a soft magnetic powdered core. The soft magnetic powdered core has a specific resistance or 10,000 μΩcm or more. A powder of a metal soap such as barium stearate or lithium stearate is used as the insulating powder lubricant.

7 Claims, 2 Drawing Sheets

SOFT MAGNETIC POWDERED CORE AND METHOD FOR PRODUCING SAME

This is a National Phase Application filed under 35 U.S.C. §371 as a national stage of International Application No. PCT/JP2010/061615, filed Jul. 8, 2010, claiming the benefit from Japanese Patent Application No. P2009-171879, filed Jul. 23, 2009, the entire content of each of which is hereby incorporated by reference in its entirety.

TECHNICAL FIELD

The present invention relates to a soft magnetic powdered core having a small iron loss, particularly a small eddy current loss, in a high frequency range and having a high magnetic flux density, and relates to a method for producing the same. More particularly, the present invention relates to a method for producing a soft magnetic powdered core that can increase the green density thereof and also can avoid a heat treatment for releasing molded strain.

BACKGROUND ART

Soft magnetic powdered cores produced by die compacting of a powder of soft magnetic metal such as iron, have a superior material yield at the time of production as compared with laminate cores using an electrical steel sheet or the like, and the material cost can be thus reduced.

Furthermore, since soft magnetic powdered cores have a high degree of freedom in shape designing, it is possible to improve their characteristics through optimal shape designing of the core. It is also possible to reduce the eddy current loss thereof to a large extent, by mixing an electrically insulating material such as a resin powder into the metal powder to insert the insulating material between the particles of the metal powder and increase the electrical insulation between them. The cores thus obtained are possible to exhibit excellent properties particularly in a high frequency range.

On the other hand, due to the insulating material such as a resin inserted between the particles of a soft magnetic powder, soft magnetic powdered cores have a drawback that, if the amount of the insulating material making up the core is large, the amount per volume (space factor) of the soft magnetic powder decreases and the magnetic flux density also decreases. In order to address this drawback, Patent Document 1 as described below discloses a technique of reducing the amount of a resin powder added, by forming an inorganic insulating film on the surface of the soft magnetic powder and thereby enhancing the electrical insulation properties of the soft magnetic powder. In recent years, there is a demand for a further enhancement of magnetic properties and Patent Document 2 as described below suggests a soft magnetic powdered core having a further decreased amount of the resin powder added.

In order to enhance the magnetic properties of a soft magnetic powdered core, it is necessary to increase the space factor of the soft magnetic powder in the core. Accordingly, densification of soft magnetic powdered cores is desired and attempts have been made to perform compacting of the soft magnetic powder at a high pressure such as 1000 MPa or higher. However, if the soft magnetic powder is compressed at a high pressure, the residual compressive stress in the soft magnetic powdered core increases so that magnetic permeability and magnetic flux density are lowered and the hysteresis loss increases at the same time.

Thus, in order to improve the magnetic properties of the soft magnetic powdered core, attempts have been made to decrease the hysteresis loss by subjecting the soft magnetic powdered core to a heat treatment at a temperature lower than the sintering temperature so as to ease the strain caused by compression. Patent Document 3 discloses a method for producing a soft magnetic powdered core by compacting a powder mixture obtained by adding a small amount of an organic resin binder to a soft magnetic metal powder coated with an inorganic insulating film, and by heat-treating then the green compact thus obtained. As such, various methods have been proposed to achieve a good balance between high magnetic flux density and low iron loss in a soft magnetic powdered core.

CITATION LIST

Patent Documents

Patent Document 1: Japanese Patent Application Laid-Open (JP-A) No. H09-320830
Patent Document 2: JP-A No. 2004-146804
Patent Document 3: JP-A No. 2005-317937

SUMMARY OF THE INVENTION

Problem to be Solved by the Invention

As described above, in order to obtain a soft magnetic powdered core having suitable magnetic properties, it is necessary to increase the space factor of the soft magnetic powder by high-density compression. However, if a high compacting pressure is employed, it cannot help performing a heat treatment in order to eliminate the strain caused by compression or curing of the added resin. Additionally, it is susceptible to a processing problem such as wear or damage of the mold.

Moreover, in the case of subjecting a soft magnetic powdered core to a heat treatment for eliminating residual stress, according to Patent Document 3 described above, heating at a temperature of approximately 500° C. is required in order to suitably eliminating the stress for reducing the hysteresis loss. However, there is a risk that a heat treatment at a high temperature may cause thermal decomposition of the organic resin. There is also another risk that phosphate-based inorganic insulating films and the like, which are generally considered to have a higher heat resistance temperature than organic resins, though, may crystallize and aggregate or may react with soft magnetic metals. Therefore, if the heat treatment is performed at a high temperature in order to decrease the hysteresis loss, the insulating material is damaged so that the specific electrical resistance remarkably falls, and the eddy current loss increases so that the iron loss is rather increased.

An object of the present invention is to provide a soft magnetic powdered core which has a high magnetic flux density and a high magnetic permeability in a high magnetic field and a high frequency range, and which has also a small iron loss, particularly a small eddy current loss, by means of a simple and convenient production method.

Another object of the present invention is to provide a soft magnetic powdered core which does not have impaired its electrical insulation properties even when the heat is applied from resin coating, resin molding or the like that comes after a winding process and that is generally carried out at about 100° C. to 150° C. as a finishing, which can maintain high specific electrical resistance and which does not have impaired magnetic properties.

Means for Solving the Problem

In order to solve the objects described above, the inventors of the present invention have conducted a thorough investigation, and as a result, the inventors have found that an insulating material instead of a resin powder, which can form electrical insulation between the particles of a soft magnetic powder, and which can thereby form a soft magnetic powdered core that can be suitably used in a high frequency range, thus accomplishing the present invention.

According to an aspect of the present invention, the subject matter is that a method of producing a soft magnetic powdered core comprises: preparing a powder mixture comprising a soft magnetic powder and an insulating powder lubricant in an amount of 0.1% by mass or more to the soft magnetic powder; and forming the powder mixture at a compacting pressure of 800 MPa or less into a green compact having a space factor of the soft magnetic powder of 93% or more.

According to another aspect of the present invention, the subject matter is that a soft magnetic powdered core comprises a green compact of a powder mixture comprising a soft magnetic powder and an insulating powder lubricant in an amount of 0.1% to 0.7% by mass to the soft magnetic powder, wherein the green compact has a space factor of the soft magnetic powder of 93% or more and a specific electrical resistance of 10000 μΩcm or more.

Effect of the Invention

According to the present invention, there is provided a soft magnetic powdered core in which the generation of stress-strain during compacting of the high-density soft-magnetic powdered core is suppressed and thus the hysteresis loss in a high frequency range is small. Since the soft magnetic powdered core does not require alleviation of the stress-strain by a heat treatment at the time of production, a soft magnetic powdered core which has a small eddy current loss and a small iron loss but does not have impaired electrical insulation properties can be obtained, and the soft magnetic powdered core exhibits suitable magnetic properties even in a high frequency range.

BEST MODES FOR CARRYING OUT THE INVENTION

Figure 3:
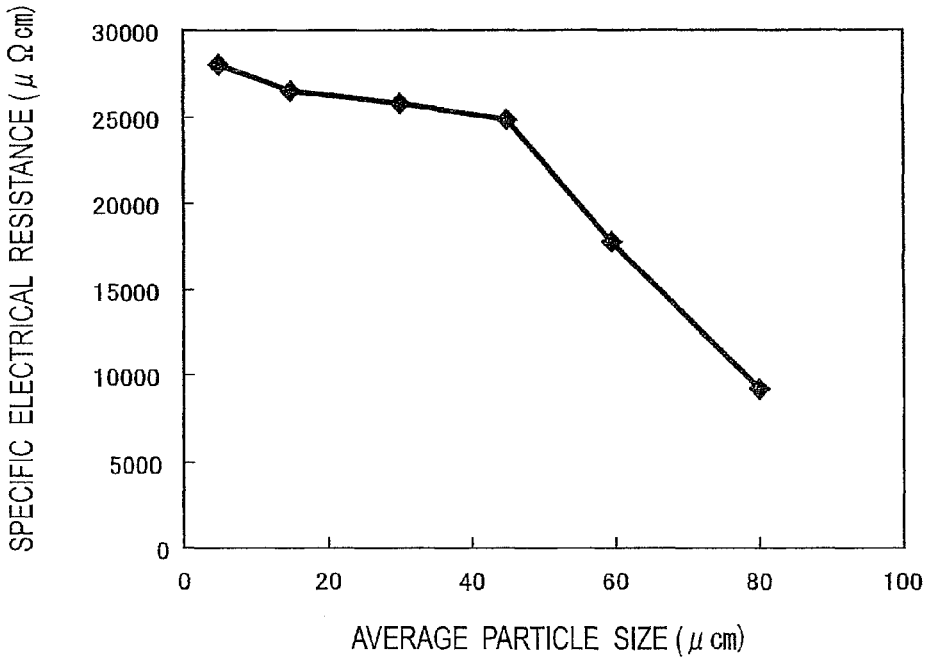
FIG. 3 is a graphic illustration showing the relationship between the average particle size of a powder lubricant and the specific electrical resistance of a green compact.

Examining the relationship between the frequency and the magnetic properties of a soft magnetic powdered core composed of a soft magnetic powder and a resin powder, the hysteresis loss increases as the frequency increases (see, for example, Patent Document 2, Table 1 and FIG. 3). Therefore, in order to obtain a soft magnetic powdered core which exhibits satisfactory magnetic properties in a high frequency range, it is important to decrease the hysteresis loss, and Patent Document 3 discloses that, in order to reduce the hysteresis loss due to the stress-strain generated at the time of high density compression, measures are taken by performing a heat treatment and thereby easing the stress-strain. However, in regard to the heat treatment, if degeneration or decomposition of the resin by heat occurs, increases in the eddy current loss and the iron loss are brought about as a result of deterioration in the electrical insulation properties. In order to prevent this, it can be conceived to use a heat resistant insulating material powder which does not undergo a decrease in the electrical insulation properties by a heat treatment. However, it is difficult in reality to find a resin material which can sufficiently endure the heating at approximately 500° C. that is effective for the easement of stress-strain. For this reason, a research has been conducted on an insulating material that can serve as a substitute for resin powder, and it has been resultantly found that, for a particular material, an increase of the hysteresis loss in a high frequency range is possibly suppressed and that the easement of stress-strain by a heat treatment may be substantially unnecessary. Thus it is now possible to provide a soft magnetic powdered core which exhibits satisfactory magnetic properties in a high frequency range.

In the present invention, an insulating powder which can serve as a substitute for a resin powder is used to form a soft magnetic powdered core, and the insulating powder used as a substitute is a powder lubricant of insulation which is used as a forming lubricant in powder metallurgy. That is, the soft magnetic powdered core of the present invention is composed of a green compact that is obtainable by die-compacting a powder mixture of a soft magnetic powder and an insulating powder lubricant, and it does not require a heat treatment for easement of stress-strain.

Generally, in compacting of a metal powder according to a powder metallurgical method, a powder lubricant is used as a forming lubricant for increasing the compressibility of the powder and facilitating the removal of compact from a compacting mold. Examples of the powder lubricant include various lubricants such as ceramics such as molybdenum disulfide and mica; semi-metals such as graphite; metals such as copper and nickel; metal soaps, which are metal salts of organic acids (water-insoluble fatty acid metal salts); and organic polymers such as amide waxes. Graphite and metals are electrically conductive, while ceramics, metal soaps and organic polymers are electrically insulating. An insulating powder lubricant can form electrical insulation between the particles of soft magnetic powder as in the case of conventional resin powders, and a soft magnetic powdered core can be produced by using the insulating powder lubricant in place of a resin powder. In order to form a suitable electrical insulation, a powder lubricant having a surface specific resistance of powder of about $1.0\times10^{11}\Omega$ or more is preferred. The powder lubricant can decrease the occurrence of stress at the time of compressing due to its lubricating properties, and thereby can enhance the compressibility of the powder. Accordingly, the compacting pressure required for high density compacting is reduced and the generation of stress-strain can be suppressed. Therefore, the heat treatment for eliminating stress-strain is to be unnecessary.

Powder lubricants differ in the lubricating properties depending on the type of the lubricant. Among the insulating powder lubricants, metal soap powders, which are metal salts of fatty acids, exhibit particularly high lubricating properties in the state as a mixture with a soft magnetic powder, and thus they increase compressibility of the powder, thereby facilitating compacting at high density. Furthermore, since generation of stress-strain is reduced, a heat treatment for eliminating stress-strain is not necessary even when the compacting is achieved at high density. Therefore, by using a metal soap powder as an insulating powder in place of the resin powder, it is possible to suitably prepare a soft magnetic powdered core in which the hysteresis loss in a high frequency range is significantly smaller than in the case of using a resin powder. Examples of fatty acids that can constitute a suitable metal soap include saturated or unsaturated fatty acids having about 12 to 28 carbon atoms, such as stearic acid, 12-hydroxystearic acid, ricinoleic acid, behenic acid, montanic acid, lauric acid, and palmitic acid, and examples of metals as constituting metal soaps include lithium, magnesium, calcium, barium, zinc, aluminum, sodium, strontium and the like. A green compact formed at high density under suppressed generation of stress-strain can form a soft magnetic powdered core which has a small hysteresis loss even if a heat treatment is not subjected, and it exhibits satisfactory magnetic properties in a high magnetic field and a high frequency range. In order to obtain a soft magnetic powdered core appropriate for a high frequency range, it is desirable to appropriately select and use an insulating powder lubricant which is capable of achieving high compressibility such that a space factor of the soft magnetic powder of 93% or higher can be achieved at a compacting pressure at which stress-strain can be easily suppressed, specifically at about 800 MPa or less, and preferably 700 MPa or less.

Furthermore, considering that the soft magnetic powdered core obtained after compacting be subjected to a post-treatment which involves heating such as resin molding, it is preferable to use a powder lubricant having a melting point or a decomposition point that is higher than the post-treatment temperature, specifically a melting point or a decomposition point of about 150° C. or higher, in order to enable the soft magnetic powdered core to maintain sufficient magnetic properties after the post-treatment. Therefore, metal soap powders having a melting point of 200° C. or higher, such as barium stearate, lithium stearate, calcium laurate, barium laurate and the like, are particularly excellent in terms of both electrical insulation properties and heat resistance, so that a soft magnetic powdered core which maintains excellent magnetic properties even after a post-treatment such as resin molding can be obtained with them. Particularly, barium stearate and lithium stearate exhibit excellent electrical insulation properties and they can suitably provide a soft magnetic powdered core having a specific electrical resistance value of 20000 μΩcm or higher. The insulating powder lubricant may be a single substance or a mixture, and one kind or two or more kinds in combination of metal soap powders can be used for the insulating powder lubricant. The insulating powder lubricant may contain an inevitable amount of impurities and, if necessary, additives such as an oxidation inhibitor may be incorporated into the insulating powder lubricant.

Since the space factor of the soft magnetic powder and the specific electrical resistance value in the soft magnetic powdered core thus obtained vary with the amount of the insulating powder lubricant added, the amount of addition is appropriately set in consideration of the space factor of the soft magnetic powder and the formation of electrical insulation. It is preferable to construct the soft magnetic powdered core in such a manner that the specific electrical resistance value is 10000 μΩcm or larger and the space factor of the soft magnetic powder is 93% or higher. According to this aspect, the amount of the insulating powder lubricant added may be preferably 0.1% to 0.7% by mass, and more preferably 0.2% to 0.5% by mass, based on the soft magnetic powder.

If the particle size of the insulating powder lubricant used is small, the insulating powder lubricant is easily dispersed uniform between the particles of the soft magnetic powder and can easily achieve satisfactory electrical insulation properties. In view of the above, the average particle size of the powder lubricant is preferably 45 μm or less. When a metal soap powder having such a small particle size is used, the eddy current loss and the iron loss of the soft magnetic powdered core, particularly in a high frequency range, are adequately decreased.

As the soft magnetic powder, powders of iron-based metals including pure iron and iron alloys such as Fe—Si alloys, Fe—Al alloys, permalloy and Sendust are usable, and a pure iron powder is excellent in terms of its high magnetic flux density and compactibility. For obtaining a high-density soft-magnetic powdered core which is appropriate for high frequency applications, a soft magnetic powder having a particle size of about 1 to 300 μm is preferred to use. It is preferable to use a soft magnetic powder which is coated on the surface thereof with an inorganic insulating film of a phosphate or the like through a chemical treatment, because it is effective for decreasing the eddy current loss of the soft magnetic powdered core. In regard to the soft magnetic powder coated with an inorganic insulating film, a soft magnetic powder can be used by processing it to form a film of an insulating inorganic compound on the surface thereof according to an already known method, or a commercially available product of soft magnetic powder product coated with an insulating film can be purchased to use as is. For example, according to Patent Document 1 mentioned above, an insulation-coated soft magnetic powder that an inorganic insulating film of about 0.7 to 11 g is formed on the surface of 1 kg of an iron powder is possibly obtained by mixing an aqueous solution containing phosphoric acid, boric acid and magnesium with an iron powder, and then drying the mixture.

As described above, the soft magnetic powder and the insulating powder lubricant are prepared and uniformly mixed, and the powder mixture is filled in a mold and compressed under pressure, thereby the powder mixture is formed into a green compact, which can be directly used as a soft magnetic powdered core. In order for the soft magnetic powdered core to exhibit excellent magnetic properties in a high frequency range, it is preferable that the space factor of the soft magnetic powder in the soft magnetic powdered core be 93% or higher. Usually, a compacting pressure necessary for performing compacting at such high density is as high as about 1000 MPa. In contrast, according to the present invention, the compressibility of the powder mixture is enhanced due to the high lubricating properties of the powder lubricant described above, and high-density compacting such as described above is possibly achieved at a compacting pressure of about 600 to 800 MPa. If barium stearate or lithium stearate is used as the powder lubricant, compacting at a pressure of 700 MPa or less is facilitated, and a green compact having a space factor of the soft magnetic powder of 94% to 96% can be easily obtained as well. At a compacting pressure of 800 MPa or less, the stress-strain generated at the time of compression can be suppressed to a low level, and a green compact having low residual stress-strain can be obtained. Therefore, the powder mixture having enhanced compressibility due to the powder lubricant can be compressed and formed into high density at a relatively low compacting pressure, and the residual stress can be reduced. Accordingly, the green compact thus obtained does not necessitate a heat treatment for stress easement, and it can exhibit satisfactory magnetic properties as a soft magnetic powdered core in a high magnetic field and a high frequency range.

A green compact having a space factor of the soft magnetic powder of 93% or higher which is obtained by the compacting according to the above description has a high magnetic flux density and then possibly forms a soft magnetic powdered core having a low iron loss. Since the soft magnetic powdered core thus obtained has low residual stress-strain even without being subjected to a heat treatment, the maximum magnetic permeability is high and the hysteresis loss is small also in the applications in a high magnetic field and a high frequency range. Therefore, the soft magnetic powdered core can be suitably utilized for the use as an iron core for booster circuits in reactors, ignition coils and the like, and for circuits used in a high magnetic field and a high frequency range, such as choke coils and noise filters. In accordance with those applications, the soft magnetic powdered core may be subjected to a necessary processing treatment such as coiling, resin coating, resin molding and component assembling, so that the products thus processed are supplied as various manufactured products.

EXAMPLE 1

According to Patent Document 2 mentioned above, an insulation-coated powder which had a phosphate compound layer formed on the surface of a pure iron powder having an average particle size of 75 μm was prepared, and one metal soap powder selected from a barium stearate powder, a lithium stearate powder and zinc stearate powder and having an average particle size of 10 μm, as a powder lubricant, was added to and mixed with the insulation-coated powder at a proportion of 0.1% to 0.9% by mass to the insulation-coated powder, for each case, referring to Table 1. Each of the powder mixtures was used to perform compacting in a cylindrically-shaped compacting mold by applying a compacting pressure of 700 MPa, thereby obtaining a cylindrical green compact having an outer diameter of 11.3 mm and a height of about 10 mm.

Figure 1:
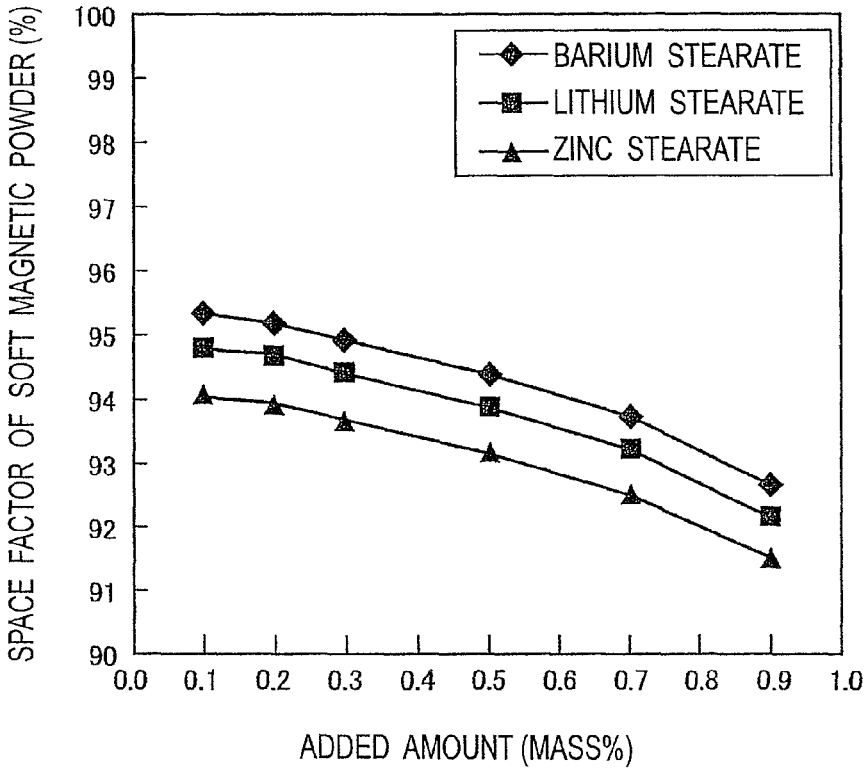
FIG. 1 is a graphic illustration showing the relationship between the amount of a powder lubricant added and the space factor of the soft magnetic powder in a green compact.

For each of the green compacts thus obtained, the space factor of the soft magnetic powder in the green compact and the specific electrical resistance were measured. The results of the measurements are shown in Table 1, and the relationships between those properties and the amount of the powder lubricant added are presented respectively in the graphic illustrations of FIG. 1 and FIG. 2.

TABLE 1

Space factor of soft magnetic powder and resistivity in green compact

| | Powder lubricant | | | | | |
|---|---|---|---|---|---|---|
| | Barium stearate | | Lithium stearate | | Zinc stearate | |
| Amount of addition (mass %) | Space factor (%) | Specific electrical resistance (μΩcm) | Space factor (%) | Specifc electrical resistance (μΩcm) | Space factor (%) | Specific electrical resistance (μΩcm) |
| 0.1 | 95.3 | 12800 | 94.8 | 10100 | 94.1 | 3300 |
| 0.2 | 95.2 | 19200 | 94.7 | 15500 | 93.9 | 4000 |
| 0.3 | 95.0 | 25000 | 94.4 | 21100 | 93.7 | 4600 |
| 0.5 | 94.4 | 36400 | 93.9 | 30120 | 93.2 | 6500 |
| 0.7 | 93.7 | 43800 | 93.2 | 37200 | 92.5 | 8500 |
| 0.9 | 92.7 | 47000 | 92.2 | 39800 | 91.5 | 8600 |

When the amount of the powder lubricant added is 0%, space factor: 95.6%, and specific electrical resistance: 2450 μΩcm In the compacting operation, the resistance at the time of stripping the green compact from the mold decreases as a powder lubricant is added. According to Table 1 and FIG. 1, a space factor of the soft magnetic powder of 93% or higher can be achieved at a compacting pressure of 700 MPa, and it is therefore obvious that the addition of a powder lubricant leads to enhancement of the compressibility of the powder mixture. However, since the space factor of the soft magnetic powder decreases according as the amount of the added powder lubricant increases, addition in an amount of 0.7% by mass or less is preferred. The powder mixture to which barium stearate or lithium stearate is added has higher compressibility than the powder mixture to which zinc stearate is added, and possibly realizes a space factor of the soft magnetic powder of about 94% or higher at the addition in an amount of 0.5% by mass or less.

Figure 2:
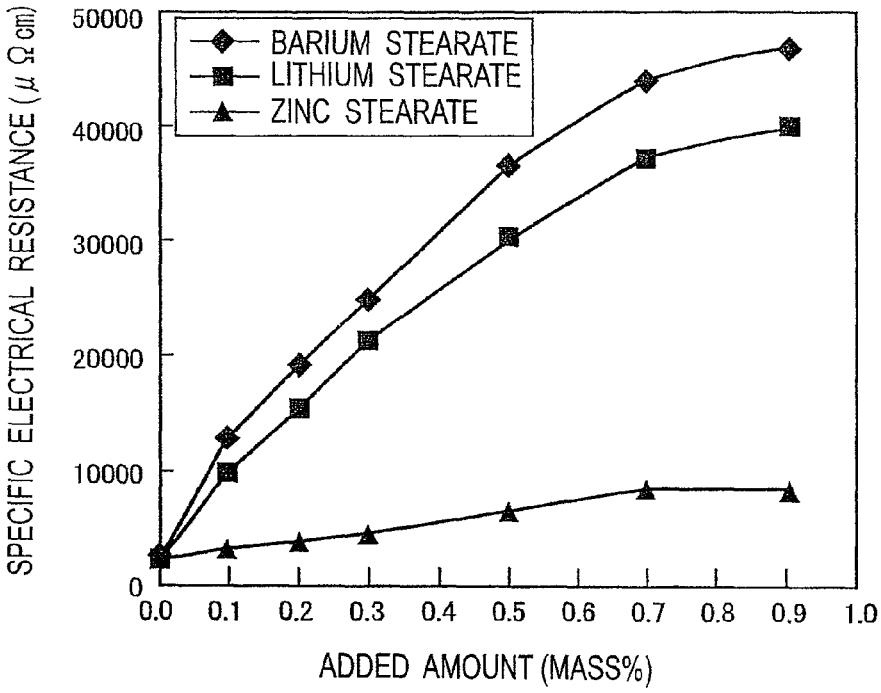
FIG. 2 is a graphic illustration showing the relationship between the amount of a powder lubricant added and the specific electrical resistance of a green compact.

Moreover, according to FIG. 2, the specific electrical resistance of the green compact increases in accordance with increase of the amount of the powder lubricant added. If taking a specific electrical resistance value of 10000 μΩcm or larger as a reference value for indicating appropriate electrical insulation properties of a soft magnetic powdered core, satisfactory electrical insulation in the case where barium stearate or lithium stearate is added is formed at an amount of addition of 0.1% by mass or greater, and a high specific electrical resistance of 15000 μΩcm or higher is obtained at an amount of addition of 0.2% by mass or more.

Therefore, according to the results described above, it is clearly shown that, when barium stearate or lithium stearate is added in an amount of 0.1% to 0.7% by mass, excellent effects are obtained for electrical insulation properties and high-density compression.

EXAMPLE 2

According to Patent Document 2 mentioned above, an insulation-coated powder which had a phosphate compound layer formed on the surface of a pure iron powder having an average particle size of 75 μm was prepared. Moreover, for the powder lubricant, barium stearate powders having different average particle sizes in the range of 5 to 80 μm were prepared as shown in Table 2.

One of the barium stearate powders having different particle sizes was added to and mixed with the insulation-coated powder as the powder lubricant at a proportion of 0.3% by mass to the insulation-coated powder in each case. Each of the powder mixtures was used to perform compacting in a cylindrically shaped compacting mold by applying a compacting pressure of 700 MPa. Thus a cylindrical green compact having an outer diameter of 11.3 mm and a height of about 10 mm was obtained.

The specific electrical resistance was measured for each of the green compacts thus obtained. The results of measurement are presented in Table 2 and FIG. 3.

TABLE 2

Resistivity of green compact

| Average particle size of powder lubricant (μm) | Specific electrical resistance (μΩcm) |
|---|---|
| 5 | 28000 |
| 15 | 26500 |
| 30 | 25800 |
| 45 | 24800 |
| 60 | 17800 |
| 80 | 9200 |

According to Table 2 and FIG. 3, the specific electrical resistance value decreases when the particle size of the powder lubricant increases. This can be speculated that, since the powder lubricant does not easily disperse uniform between the particles of the soft magnetic powder, formation of electrical insulation is made locally difficult and the specific electrical resistance is thus reduced. It is understood from FIG. 3 that, in order to form satisfactory electrical insulation, a particle size of the powder lubricant of 45 μm or less is preferred.

EXAMPLE 3

According to Patent Document 2 mentioned above, an insulation-coated powder which had a phosphate compound layer formed on the surface of a pure iron powder having an average particle size of 75 μm was prepared, and as a powder lubricant, one metal soap powder selected from a barium stearate powder, a lithium stearate powder and zinc stearate and having an average particle size of 10 μm was added to and mixed with the insulation-coated powder at a proportion of 0.3% by mass to the insulation-coated powder in each case. Each of the powder mixtures was used to perform compacting in a cylindrically shaped compacting mold by applying a compacting pressure of 700 MPa, thus obtaining a cylindrical green compact having an outer diameter of 11.3 mm and a height of about 10 mm.

For each of the green compacts thus obtained, the specific electrical resistance was measured, and then the green compacts were placed in a constant temperature chamber and heated for 30 minutes at 150° C. For the green compacts obtained after heating, the specific electrical resistance was measured again. The results of the measurements are shown in Table 3.

TABLE 3

Specific electrical resistance of green compact

| Powder lubricant | Specific electrical resistance (μΩcm) Before heating | After heating |
|---|---|---|
| Barium stearate | 25000 | 24700 |
| Lithium stearate | 21100 | 20600 |
| Zinc stearate | 4600 | 2740 |

The heating at 150° C. as described above is meant to simulate that the soft magnetic powdered core be subjected to a post-treatment such as resin molding.

According to Table 3, in the case where barium stearate (melting point: 225° C. or higher) or lithium stearate (melting point: about 220° C.) is used as a powder lubricant, the variation in the specific electrical resistance before and after the heating is small and the soft magnetic powdered cores maintain high specific electrical resistance such as 20000 μΩcm or higher even after heating. Therefore, the soft magnetic powdered cores can sufficiently cope with a post-treatment involving heating. On the other hand, in the case where zinc stearate (melting point: 125° C.) is used, the decrease in the specific electrical resistance by heating is caused large. Therefore, in order to cope with a post-treatment involving heating, it is important to select a powder lubricant having a melting point that is higher than the temperature of the post-treatment.

EXAMPLE 4

Sample 1

An insulation-coated powder which had a phosphate compound layer formed on the surface of a pure iron powder having an average particle size of 75 μm was prepared, and a barium stearate powder having an average particle size of about 10 μm, as a powder lubricant, was added to and mixed with the insulation-coated powder at a proportion of 0.3% by mass to the insulation-coated powder, thus preparing a raw material powder. This raw material powder was used to perform compacting in an annular-shaped compacting mold by applying a compacting pressure of 700 MPa, thus obtaining a ring-shaped green compact (sample 1) having an outer diameter of 30 mm, an inner diameter of 20 mm, and a height of 5 mm.

Sample 2

A green compact which was produced in the same manner as in the case of sample 1 was placed in a heat treatment furnace, and was heated at 650° C. for 30 minutes.

Sample 3

The insulation-coated powder used for sample 1 was prepared, and a thermosetting polyimide resin powder (KIR series, manufactured by Kyocera Chemical Corp.) having a particle size of about 20 μm was added to and mixed with the insulation-coated powder at a proportion of 0.3% by mass to the insulation-coated powder, thus preparing a raw material powder. The raw material powder was subjected to compacting in an annular-shaped compacting mold which had been coated with a die lubricant on the inner surfaces, by applying a compacting pressure of 700 MPa. Thus a ring-shaped green compact having an outer diameter of 30 mm, an inner diameter of 20 mm, and a height of 5 mm was obtained.

Sample 4

The same procedure as in the case of sample 3 was repeated, except that the compacting pressure was changed to 980 MPa, and a ring-shaped green compact was thus obtained.

Sample 5

A green compact which was produced in the same manner as in the case of sample 4 was placed in a heat treatment furnace, and was heated at 650° C. for 30 minutes.

(Measurement of Magnetic Properties)

For each of the green compacts of sample 1 to sample 5 obtained as described above, the specific electrical resistance was measured. Furthermore, the iron loss, hysteresis loss and eddy current loss at an excitation magnetic flux density of 0.4 T and a frequency of 2 kHz were measured. These results are shown in Table 4.

Moreover, the magnetic permeability, coercive force and remanent magnetic flux density at an excitation magnetic flux density of 0.4 T and a frequency of 50 Hz or 2 kHz were measured. The results are shown in Table 5.

TABLE 4

Magnetic properties of green compact

| Sample | Heat treatment | Specific electrical resistance (μΩcm) | Iron loss (W/kg) | Hysteresis loss (W/kg) | Eddy current loss (W/kg) |
|---|---|---|---|---|---|
| 1 | — | 25000 | 77 | 57 | 20 |
| 2 | 650° C. | 200 | 225 | 38 | 187 |

TABLE 4-continued

| Magnetic properties of green compact | | | | | |
|---|---|---|---|---|---|
| Sample | Heat treatment | Specific electrical resistance (μΩcm) | Iron loss (W/kg) | Hysteresis loss (W/kg) | Eddy current loss (W/kg) |
| 3 | — | 8000 | 118 | 58 | 60 |
| 4 | — | 6500 | 136 | 64 | 72 |
| 5 | 650° C. | 180 | 234 | 37 | 196 |

The stress-strain generated by pressing increases the hysteresis loss in a high frequency range. However, the hysteresis loss of sample 1 is relatively small. Since the difference between the hysteresis loss of sample 1 and the hysteresis loss of sample 2 that has been heat treated is small, it can be seen that the residual stress-strain in sample 1 is small, and the need for stress easement through a heat treatment is low.

Moreover, in the sample 1, the eddy current loss is suppressed to a low level due to the electrical insulation properties that exhibit high specific electrical resistance. To the contrary, in sample 2, the specific electrical resistance decreases, and the eddy current loss increases. This indicates dielectric breakdown due to thermal degeneration or loss of the powder lubricant at the time of heat treatment, and it can be speculated that the insulating film of the soft magnetic powder might have also been damaged.

Samples 3 to 5 are conventional type green compacts using a resin powder. Here, it is noted that, in the case of using merely the resin powder, the compacting has been performed with application of the die lubricant onto the inner surfaces of the mold, because of the lubricating properties being insufficient for removing the green compact from the mold. In comparison with sample 1, the specific electrical resistance of sample 3 is lower and the eddy current loss is higher. In sample 4 that has been produced by increasing the compacting pressure in order to increase the density from the sample 3 and thereby improve the magnetic permeability and the like, it can be seen that the hysteresis loss increased, and that the stress-strain generated as a result of high pressure compacting is large. Moreover, it can be speculated that a decrease in the specific electrical resistance and an increase in the eddy current loss have been caused by decrease in the electrical insulation properties due to the damage of the electrical insulation of the resin or due to the plastic deformation of the soft magnetic powder, under the effect of high pressure. Therefore, it is considered that the resins are insufficient in lubricating properties. In the sample 5 that has been subjected to a heat treatment for the purpose of stress easement, the specific electrical resistance is significantly low, and that means it has been caused by thermal degeneration or decomposition of the resin. Thus it is understood from the above that, if it is intended to appropriately ease the stress under the conditions that the thermal degeneration or decomposition of the resin can be avoided, such conditions for the heat treatment are not easily settled.

TABLE 5

| Magnetic properties of green compact | | | | | | | |
|---|---|---|---|---|---|---|---|
| | Heat | Magnetic permeability | | Coercive force (A/m) | | Residual magnetic flux density (T) | |
| Sample | treatment | 50 Hz | 2 kHz | 50 Hz | 2 kHz | 50 Hz | 2 kHz |
| 1 | — | 332 | 314 | 188 | 235 | 0.10 | 0.10 |
| 2 | 650° C. | 447 | 278 | 105 | 631 | 0.07 | 0.24 |
| 3 | — | 270 | 257 | 182 | 413 | 0.10 | 0.15 |

TABLE 5-continued

| Magnetic properties of green compact | | | | | | | |
|---|---|---|---|---|---|---|---|
| | Heat | Magnetic permeability | | Coercive force (A/m) | | Residual magnetic flux density (T) | |
| Sample | treatment | 50 Hz | 2 kHz | 50 Hz | 2 kHz | 50 Hz | 2 kHz |
| 4 | — | 299 | 268 | 189 | 421 | 0.10 | 0.17 |
| 5 | 650° C. | 451 | 273 | 112 | 627 | 0.08 | 0.23 |

The green compact of sample 1 exhibits a magnetic permeability of 300 or higher both at 2 kHz, which is a high frequency, and at 50 Hz, which is a commercial frequency, and thus its variation is small. Moreover, the coercive force and the remanent magnetic flux density are 250 A/m or less and 0.10 T or less, respectively, at both frequency ranges. Thus it can be seen that the green compact exhibits stable magnetic properties, irrespective of the frequency range. On the other hand, in sample 2, the magnetic permeability at 50 Hz is high, and it can be seen that stress easement by a heat treatment is effective for an enhancement of the magnetic permeability. However, since the magnetic permeability at 2 kHz rather decreases, it is understood that, at a high frequency range, a decrease in the magnetic permeability manifests as surpassing the effect provided by stress easement. And, also the coercive force and the remanent magnetic flux density increase. Therefore, they are understood as being caused by degeneration of the forming lubricant.

The low magnetic permeability of sample 3 is attributable to the low density caused by insufficient pressure at the time of compacting, and this must have been improved in sample 4 which has been formed at a high pressure. However, the actual magnetic permeability is not sufficiently improved because of the residual stress-strain. In sample 5, the magnetic permeability at 50 Hz is high but decreases at 2 kHz, and it is due to the same reason as in the case of sample 2. Thus it is understood that the coercive force and the remanent magnetic flux density at a high frequency range increase because of thermal degeneration of the resin.

EXAMPLE 5

For the green compacts of sample 1 and sample 2 obtained in Example 4, the B-H curves (magnetic hysteresis curves) at a magnetic field of 3000 A/m and a frequency of 1 kHz were drawn up. The B-H curve of sample 1 is shown in FIG. 4(*a*), and the B-H curve of sample 2 is shown in FIG. 4(*b*).

Figure 4:
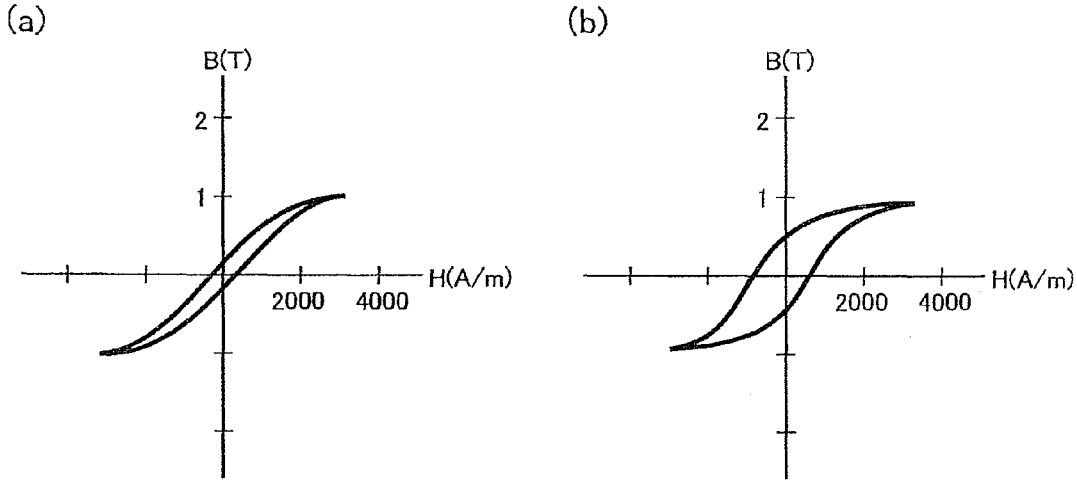
FIG. 4(*a*) is a graphic illustration showing the B-H curve of sample 1 of Example 4, and FIG. 4(*b*) is a graphic illustration showing the B-H curve of the green compact of sample 2.

In FIG. 4(*a*), the saturation magnetic flux density is 1.05 T, the remanent magnetic flux density is 0.18 T, the coercive force is 315 A/m, and the iron loss is 77 W/kg. In FIG. 4(*b*), the saturation magnetic flux density is 0.95 T, the remanent magnetic flux density is 0.48 T, the coercive force is 680 A/m, and the iron loss is 225 W/kg.

As can be clearly seen from the drawings, the magnetic hysteresis curve of sample 1 has a small change in the gradient of the curve (or magnetic permeability) in the range of 1 to 3000 A/m, and this means that the difference in the magnetic permeability between the low magnetic field and the high magnetic field is small. On the other hand, in sample 2, the gradient of the curve (magnetic permeability) at a low magnetic field of 1000 A/m or less is high; however, at a high magnetic field of 1000 A/m or more, the magnetic flux density is saturated and the magnetic permeability is decreased.

INDUSTRIAL APPLICABILITY

A soft magnetic powdered core exhibiting satisfactory magnetic properties in a high frequency range is provided. The soft magnetic powdered core exhibits excellent performance when used as an iron core of booster circuits in reactors, ignition coils and the like, and of circuits used in a high magnetic field and a high frequency range, such as choke coils and noise filters, and it contributes to an enhancement of the performance of various products for high frequency applications. The soft magnetic powdered core is also capable of coping with the use in commercial frequency ranges and medium frequency ranges, such as in electric components and motor cores for automobiles or general industrial use, and allows a supply of products with high general-purpose applicability.

The invention claimed is:

1. A method of producing a soft magnetic powdered core, comprising:

preparing a powder mixture comprising a soft magnetic powder and an insulating powder lubricant in an amount of 0.1% by mass or more to the soft magnetic powder, the soft magnetic powder comprising an iron powder, and the insulating powder lubricant comprising barium stearate and having an average particle size of 45 μm or less; and forming the powder mixture at a compacting pressure of 800 MPa or less into a green compact having a space factor of the soft magnetic powder of 93% or more.

2. The method of producing a soft magnetic powdered core according to claim 1, wherein the soft magnetic powder has an inorganic insulating film coating the surface of the soft magnetic powder.

3. The method of producing a soft magnetic powdered core according to claim 1 further comprising:

subjecting the green compact to a post-treatment involving heating at a temperature of 150° C. or lower, wherein the insulating powder lubricant comprises a metal soap powder having a melting point that is higher than the temperature of the post-treatment.

4. The method of producing a soft magnetic powdered core according to claim 1, wherein the insulating powder is added at a proportion of 0.7% by mass or less to the soft magnetic powder.

5. A soft magnetic powdered core comprising a green compact of a powder mixture consisting essentially of:

a soft magnetic powder which comprises an iron powder and whose surface is coated with an inorganic insulating film; and an insulating powder lubricant in an amount of 0.1% to 0.7% by mass to the soft magnetic powder, wherein the insulating powder lubricant comprises a barium stearate powder and the green compact has a space factor of the soft magnetic powder of 93% or more and a specific electrical resistance of 10000 μΩcm or more.

6. The soft magnetic powdered core according to claim 5, in combination with a circuit selected from the group consisting of a reactor, an ignition coil, a choke coil and a noise filter.

7. The method of producing a soft magnetic powdered core according to claim 1, wherein the compacting pressure is 700 MPa or less.

* * * * *